United States Patent [19]

Nitto

[11] 4,402,414

[45] Sep. 6, 1983

[54] MEANS FOR DISTRIBUTING LOAD UNIFORMLY TO WHEELS

[75] Inventor: Junzaburo Nitto, Hachioji, Japan

[73] Assignee: Kenki Engineering Co., Ltd., Tokyo, Japan

[21] Appl. No.: 219,552

[22] Filed: Dec. 23, 1980

[30] Foreign Application Priority Data

Dec. 24, 1979 [JP] Japan ..... 54-167797
Jul. 17, 1980 [JP] Japan ..... 55-98113

[51] Int. Cl.[3] ..... B66C 23/84

[52] U.S. Cl. ..... 212/226; 212/211; 212/253; 104/35; 105/163 R

[58] Field of Search ..... 105/163, 180, 195, 209; 104/35, 46; 212/211–218, 195, 223–254

[56] References Cited

U.S. PATENT DOCUMENTS 2,048,280 7/1936 Möhl ..... 105/209
2,089,110 8/1937 Bugatti ..... 105/195
2,495,813 1/1950 Jones ..... 104/35
3,131,818 5/1964 Allin ..... 212/253

FOREIGN PATENT DOCUMENTS 669485 12/1938 Fed. Rep. of Germany ..... 105/195
54-9762 11/1975 Japan .

*Primary Examiner*—Trygve M. Blix
*Assistant Examiner*—Stephen P. Avila
*Attorney, Agent, or Firm*—Flynn, Thiel, Boutell & Tanis

[57] ABSTRACT

An assembly to distribute an extremely heavy load uniformly to wheels when the load is moved slowly on irregular rails. Balancelike distribution links are pivotally mounted on a slewing frame as a truck at certain intervals, and another balancelike distribution links are pivotally mounted directly or indirectly on the axles of the wheels. The distribution links on the slewing frame and the distribution links on the axles are joined alternately with connecting bodies which are connecting links or connecting rollers.

7 Claims, 16 Drawing Figures

MEANS FOR DISTRIBUTING LOAD UNIFORMLY TO WHEELS

BACKGROUND OF THE DISCLOSURE

The present invention relates to a means to distribute a heavy load uniformly to a plurality of wheels that rotate slowly on circular rails, as in a large crane. The uniform distribution of load is accomplished even when the rails are irregular or inclined.

A crane for moving slowly (say 5 m/min) an extremely heavy object such as a bridge girder weighing hundreds or thousands of tons at a building or construction site is usually installed on a slewing frame provided with a plurality of wheels which roll on circular rails.

It is necessary for the crane supported on rails that the wheels be machined to an accurate diameter, the axles be aligned at a uniform height, and the rail surface be very smooth. To achieve this goal, a high degree of machine finish and great rigidity to prevent distortion are required.

Unfortunately, however, this kind of crane is so large that satisfactory precision is not obtained when assembled and installed at job site.

To solve this problem we made an invention of practical value which matured into Japanese Pat. No. 979,333. We further filed a Japanese patent application (Ser. No. 114898/1979) on the improvement of the previous invention which is characterized by that the axles are oscillated so that they are balanced when the wheels meet with irregular parts of rails. It has been found, however, that this improvement has a problem that the wheel sways when the axles are inclined or load bearing capacity decreases sharply even when the axles are inclined only a little if the wheels are attached to the axles with swivel washers to prevent the wheels from swaying.

BRIEF SUMMARY OF THE INVENTION

It is an object of this invention to remove the drawbacks mentioned above. This object was achieved by attaching the wheels to the truck rotatably mounted on the supporting beam, instead of attaching the wheels directly to the supporting beam which corresponds to the axle, and by connecting the supporting beam at its base with the distribution links and attaching the supporting beam to the slewing frame. This structure prevents swaying and keeps load bearing capacity.

It is another object of this invention to remove a drawback to the means constituted to achieve the first object. That is, the means constituted to achieve the first object has drawbacks that slight difference in pitch of each load distribution link results in the inclination of the connecting links, load distribution is not necessarily uniform, and manufacture and assembly are complex. The second object of this invention is to remove these drawbacks completely. In this invention, the links as the connecting body are replaced by the rollers, which are smooth in lateral movement, keep a certain distance (equal to the radius), are uniform in load distribution, and are practically easy to manufacture and assemble.

The other objects and advantages of this invention will be apparent from the following detailed description when the same is read in connection with the accompanying drawings.

DETAILED DESCRIPTION OF THE INVENTION

Some embodiments according to this invention will be described with reference to the drawings.

Figure 1:
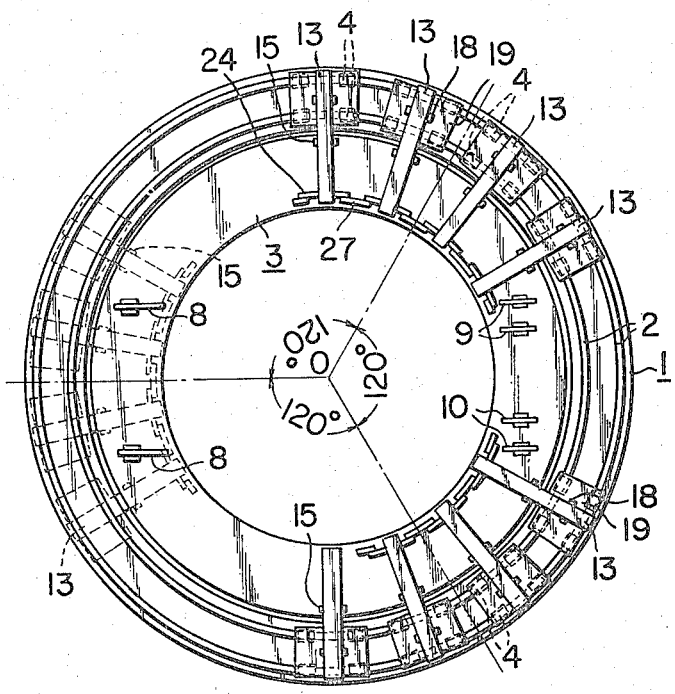
FIG. 1 is a plan view of a slewing crane, with the mast omitted, which is one application of the means according to this invention.
Figure 2:
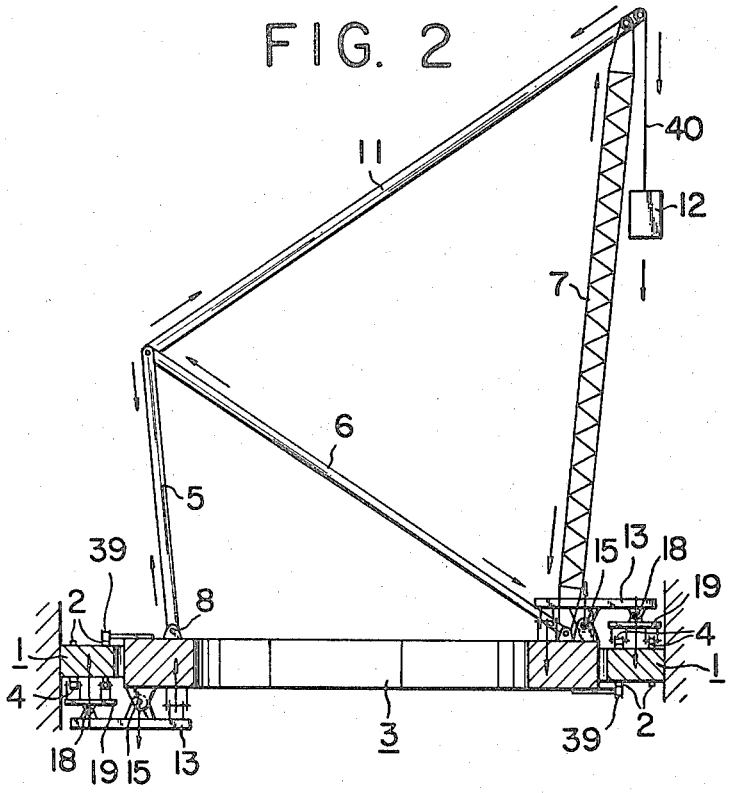
FIG. 2 is a longitudinal sectional view of the crane as shown in FIG. 1.
Figure 3:
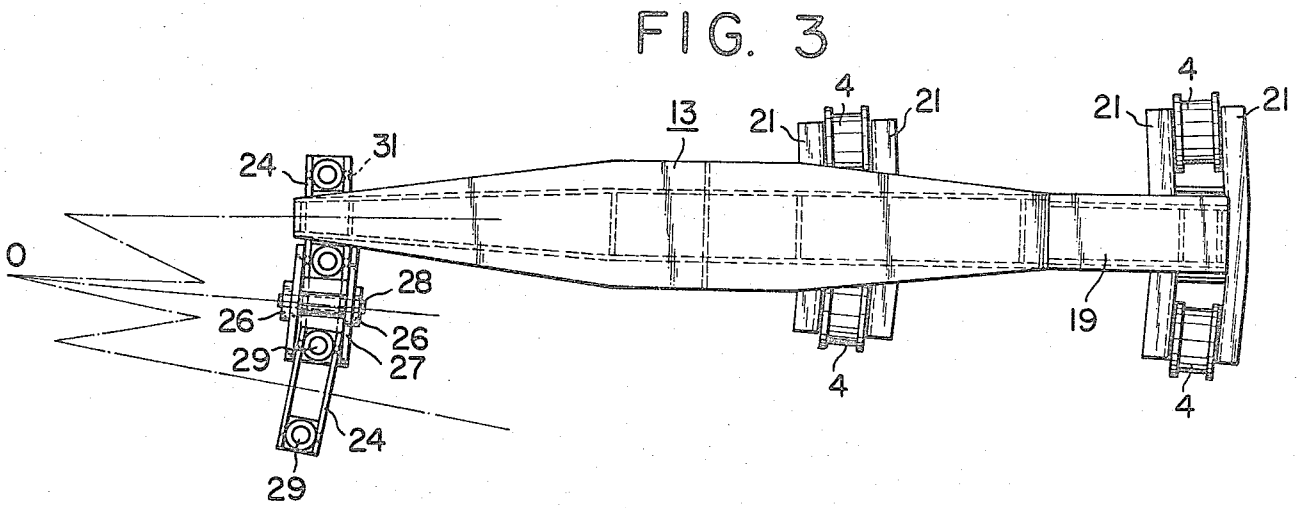
FIG. 3 is an enlarged plan view of a supporting frame.

FIG. 1 is a plan view of a crane which is an embodiment of this invention, and FIG. 2 is a longitudinal sectional view of the crane. These figures show that the circular stationary base (1) is provided with two circular rails (2) on both the upper and under sides thereof. Within said stationary base (1) is arranged the slewing frame (3) which is turned by a plurality of wheels (4). To the upper side of this slewing frame (3) are rotatably connected the stay (5), mast (6), and jib (7) by foot pins (8), (9), and (10), respectively. Load (12) is suspended from the top of the boom (11).

The wheels (4) attached to the slewing frame (3) are made up of at least two groups of wheels, each group being mounted on the upper and under sides of the slewing frame (3). Each group of wheels is made up of wheels (4) mounted on a plurality of supporting beams (13).

Figure 4:
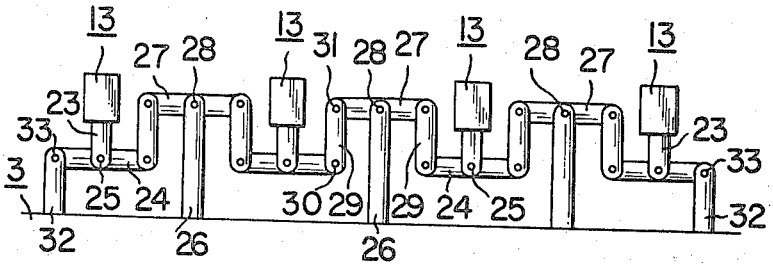
FIG. 4 is a schematic drawing illustrating how the load distribution links are joined.
Figure 5:
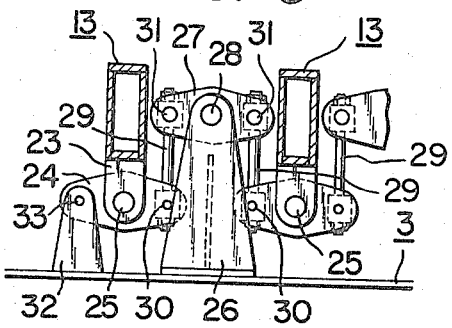
FIG. 5 is an elevation of a load distribution link.
Figure 7:
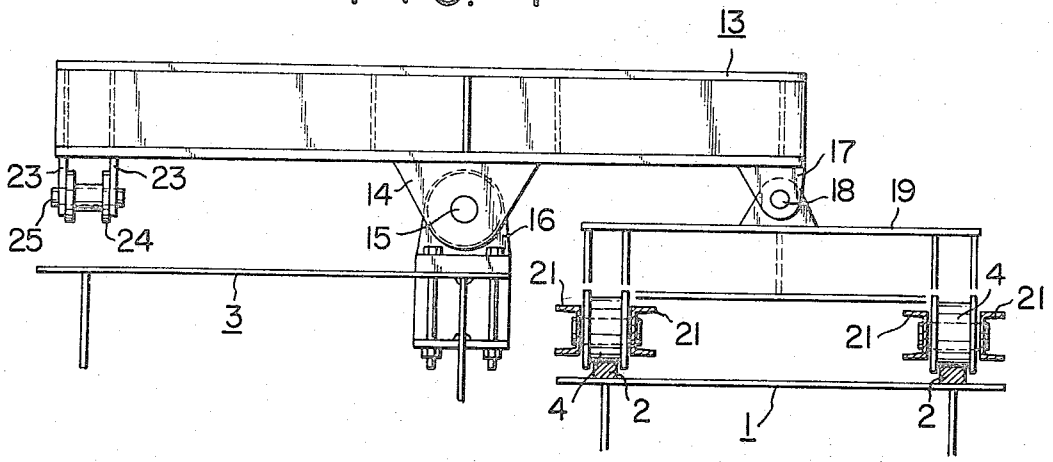
FIG. 7 is an elevation of a supporting beam.
Figure 8:
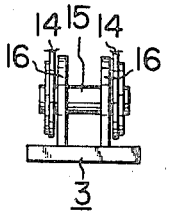
FIG. 8 is an elevation showing how the supporting beam is attached to the slewing frame.
Figure 9:
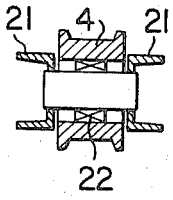
FIG. 9 is a sectional view of a wheel.

In the embodiment as shown in FIG. 1, the wheels (4) are divided into three groups, each group of the wheels bears four supporting beams (13) which are radially disposed at certain angular intervals around the center (0). The supporting beam (13) is mounted on the slewing frame (3) through the plate body (14) attached to the center of the under side of the supporting beam and the plate body (16) attached to the slewing frame, both plate bodies being connected by the pin (15), as shown in FIGS. 7 and 8. The supporting beam (13) is also mounted on the truck (19) through the plate body (17) attached to the under side of the forward end of the supporting beam and the plate body (20) attached to the truck (19), both plate bodies being connected by the pin (18). Two channel shape steels (21) are fixed, along the two rails (2), to the under side of the truck (19). To both ends of the channel shape steel are mounted the wheels (4) through the spherical washer (22) as shown in FIG. 9. On the top of the truck (19) are mounted a motor and other drive unit (not shown) as required. The wheels (4) mounted on the truck (19) roll on the rails (2). The inner ends of the adjoining supporting beams (13) of one group are connected to the slewing frame (3) as shown in FIG. 4. The plate body (23) attached to the inner end of the supporting beam (13) is pivotally mounted on the center of the distribution link (24) with the pin (25). The slewing frame (3) is provided with a plurality of long supporting plates (26), to each of which are pivotally mounted the distribution link (27) with the pin (28). The adjoining distribution links (24) and (27) are rotatably connected by the connecting link (29) and pins (30),(31). However, the terminal distribution links (24) are connected directly to the end stopper (32) with the pin (33), as shown in FIGS. 4 and 5.

Figure 6:
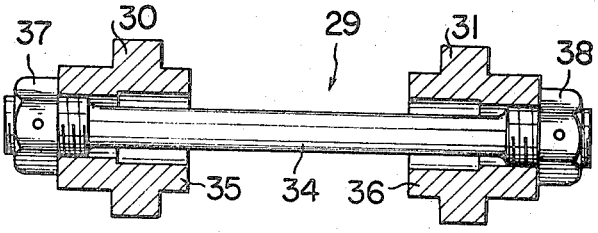
FIG. 6 is a sectional view of a connecting link.

As shown in FIG. 4, the pin (25) of the supporting beam (13) is lower than the pin (28) of the supporting plate (26) because there is only compression force in the case of crane as shown in FIGS. 1 and 2. In actuality, the link schematically shown in FIG. 4 is constructed as shown in FIGS. 5 and 6. Two plate bodies (23) are attached vertically to the under side of the inner end of the supporting beam (13). The plate bodies (23) are pivotally mounted on the center of the distribution link (24) with the pin (25). The end stoppers (32) of the same height of said pin (25) are attached to the slewing frame (3). Between these end stoppers (32) and (32) are installed the supporting plates (26) which are higher than said pin (33). To the supporting plate (26) is pivotally mounted the center of the distribution link (27) with the pin (28). This distribution link (27) and said distribution link (24) are joined by the connecting link (29). The distribution links (24) at both ends are pivotally mounted directly on the end stoppers (32) with the pins (33). The said connecting links (29) are such that rings (35) and (36) are rotatably fitted to both ends of the cylindrical link (34), as shown in FIG. 6. The pins (30) and (31) which are integral parts of the rings (35) and (36) are rotatably fitted to the distribution links (24) and (27). The retaining nuts are indicated by numerals (37) and (38).

As shown in FIG. 1, four supporting beams (13) form a group and three groups are attached to the slewing frame (3) at angular intervals of 120°. At the opposite side of each of these three groups of wheels (4) are installed the wheels (39) to prevent the crane from tipping when blown by a gust, as shown in FIG. 2.

Now, we will describe the action of the above-mentioned apparatus.

In operation, the rope (40), jib (7), boom (11), mast (6), and stay (5) receive the force in the direction of arrow due to the lifting load (12) and dead load. Under this condition, an upward force is exerted to the distribution links (24) and (27) and the truck (19) and a downward reaction force is exerted to the intermediate pin (28) at the two groups of the supporting beams (13) on the slewing frame (3) placed under the lifting load (12). Thus, a balance is maintained as a whole.

Now, let us assume that the rails are slightly irregular and inclined. As the slewing frame turns slowly, some of the wheels (4) are moved up and down by the irregular rails. Since the wheels (4) are mounted on the truck (19) which is mounted on the supporting beam (13) with the pin (18), the inclination of the truck is absorbed mostly by the pin (18) and a part of inclination is transmitted to the supporting beam (13). Since the supporting beam (13) oscillates about the center of the intermediate pin (15), the inclination of the supporting beam (13) is transmitted to the adjoining supporting beam (13) in the same group through the dis. ibution link (24), the connecting link (29), and distribution link (27). Thus, the supporting beam (13) inclines about the intermediate pin (15), and this movement is transmitted to the wheel (4) through the pin (18) and the truck (19). In this manner, the displacement of one wheel (4) is absorbed as the result of displacement of all the wheels (4) in the same group. A great displacement is transmitted to the wheels (4) in another group until a balance is attained with displacement of all the wheels (4).

In the above-mentioned embodiment, four supporting beams (13) comprise one group, but the present invention is not limited to such a constitution; two, three, or five or more supporting beams (13) may comprise one group.

In the embodiment as illustrated in FIG. 4, the pin (25) of the supporting beam (13) is positioned lower than the pin (28) of the supporting plate (26) and the connecting links (29) are parallel with each other. Therefore, this mechanism is utilized only when a compression force is applied to the supporting beam (13).

Figure 10:
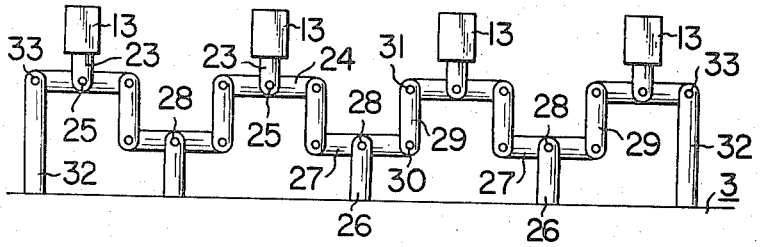
FIG. 10 is another schematic drawing showing how load distribution links are joined.
Figure 11:
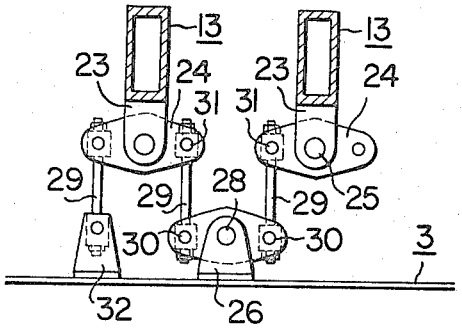
FIG. 11 is an elevation of the load distribution link as shown in FIG. 10.

If tension is applied to the supporting beam (13), the distribution function does not work with the mechanism as shown in FIG. 4. To overcome this disadvantage, the pin (25) of the supporting beam (13) should be positioned higher than the pin (28) of the supporting plate (26), as schematically shown in FIG. 10. An embodiment is shown in FIG. 11, in which almost nothing is different from the embodiment of FIG. 5 except the relative positions of the pins (25) and (28). Incidentally, the end stopper (32) and the distribution link (24) may be joined directly with the pin (33) as shown in FIG. 10, but they may be joined with the connecting link (29) as shown in FIG. 11. This is applicable also to the embodiments shown in FIGS. 4 and 5.

In order for the mechanism as shown in FIGS. 4 and 10 to cope with both compression and tension, the connecting links (29) should be joined to the distribution links (24) and (27) in such a manner that they are not parallel with each other. In other words, the connecting links (29) should be arranged so that they get wider or narrower downward.

It has been mentioned that some problems are involved in the above-mentioned embodiment in which the connecting links (29) are employed as the connecting body. Now, we will describe another embodiment with reference to FIGS. 12 to 16 in which connecting rollers are employed as the connecting body.

Figure 12:
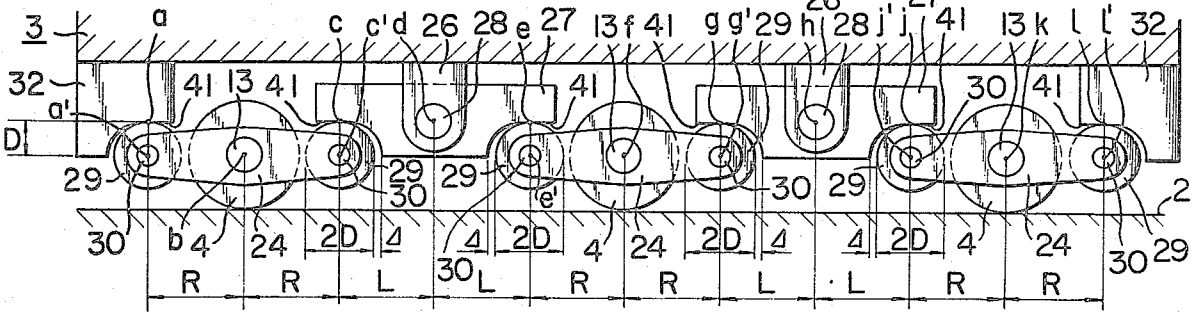
FIG. 12 is a diagrammatical view of another embodiment in which the connecting links are replaced by the connecting rollers.
Figure 13:
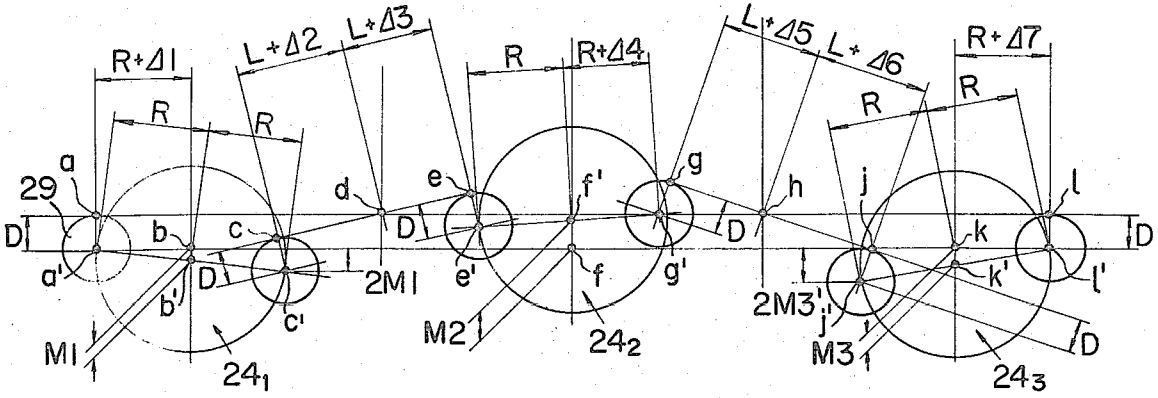
FIG. 13 is a schematic drawing showing how the connecting rollers as shown in FIG. 12 perform load distribution action.

In FIGS. 12 and 13 which illustrate the principle of the embodiment, the truck (3) is equivalent to the slewing frame in the above-mentioned embodiment. The truck (3) is provided on its under surface with the end stoppers (32) for each group of wheels. Between these end stoppers (32) are installed the supporting plates (26) at prescribed intervals. On this supporting plate (26) is pivotally mounted the symmetrical distribution link (27). The arc-shaped surface (41) on which the roller rolls is made on the under surface at both ends of the distribution link (27) and on the under surface at the inside of the end stopper (32).

The axle (13) as the supporting beam is not connected directly with the truck (3). On this axle (13) are rotatably mounted the wheel (4) and the symmetrical distribution link (24). At both ends of the distribution link (24) are rotatably mounted the connecting roller (29) with the roller pin (30). The rail is indicated by numeral (2).

The dimensions of each part are established as follows: R is assumed to be the distance between the center (b, f, k) of the axle (13) and the center (a', c', e', g', j', l') of the roller pin (30). L is assumed to be the distance between the center (d, h) of the pin (28) and the center (c', e', g', j') of the outside roller pin (29). D is assumed to be the radius of the connecting roller (29) and Δ is assumed to be the play between the connecting roller (29) and the arc-shaped surface (41).

The principle for transmission of load under the constitution mentioned above is described below. The wheel load is transmitted to the distribution link (24) through the rail (2), the wheel (4), and the axle (13). The balance-like distribution link (24) divides the wheel load into two and transmits them to the truck through the pin (3) and the connecting roller (29) at both ends. The end stoppers (32) at both ends receives a half each of the wheel load from the connecting roller (29) and transmits it to the truck (3). The load on the other connecting rollers (29) is transmitted to the truck through the distribution link (27), the pin (28), and the supporting plate (26). The distribution link (27) is also like a balance and the supporting plate (26) combines the loads from the two connecting rollers (29) and transmits the combined load to the truck (3).

The relative positions of the parts are described below. The axle (13) and the connecting pins (30) are arranged on a straight line. In other words, under the unloaded condition the points a', b, c', e', f, g', j', k, and l are aligned on a straight line which is parallel with the rail (2). The contacts (a, c, e, g, j, l) between the connecting roller (29) and the arc-shaped surface (41) formed on the distribution link (27) and the centers (d, h) of the pin (28) are on the same straight line. The radius (D) of the connecting roller (29) is constant. Thus, under the unloaded condition the points a, c, d, e, g, h, j, and l are on a straight line which is parallel with the line (a'-l') and the rail (2). The distance between the two straight lines is equal to D. The length of the arm of the distribution link (24) is a constant R as mentioned before. The standard arm length of the distribution link (27) is a constant L as mentioned before. The connecting roller (29) is arranged so that it can move as much as ±Δ. It should be noted that Δ is very small and its variation is not a problem in actual operation.

According to the embodiment of this invention, the following horizontal errors and vertical errors that will occur at each part during operation can be absorbed.

(a) Errors caused by the irregularity of the rail (2).
(b) Vertical errors caused by the error in the diameter of the wheel (4) or the connecting roller (29).
(c) Vertical errors caused by the misalignment. The line connecting the roller pins (30) and the line connecting the pins (28) are not parallel with each other.
(d) Vertical errors caused by the misalignment. The line connecting the contacts (a, c, e, g, j, l) between the arc-shaped surface (41) and the connecting roller (29) and the line connecting the centers (d, h) of the pin (28) are not parallel with each other.
(e) Vertical error caused by the relative errors of the end stopper (32) and the supporting plate (26).
(f) Vertical error caused by the irregularity of the truck (3).
(g) Longitudinal error caused by variations of the distribution link (24) and the arm length (R).
(h) Longitudinal errors caused by variations of the arm length (L) due to pitch error of the supporting plate (26).

How these errors are absorbed are explained below.

(1) Effect of horizontal longitudinal errors

It is assumed that horizontal longitudinal errors are expressed by $R \pm \Delta'$ or $L \pm \Delta'$. Then, the variation of the load is $(R \pm \Delta')/R$ or $(L \pm \Delta')/L$. This relation is established within the range of $\Delta' < \Delta$. In actuality, $\Delta'$ and $\Delta$ are very small as compared with R and L (0.03:1 to 0.05:1 in the embodiment) and variations are so small (±3–5% in the embodiment) that sufficient load distribution can be realized.

(2) Effect of vertical errors

FIG. 13 shows how vertical errors due to irregular rail height are absorbed.

(a) Errors of rail

It is assumed in FIG. 13 that the rail height differs from one place another; i.e., the height difference is assumed to be $-M_1$ at the first axle (b-b'), $+M_2$ at the second axle (f-f'), and $-M_3$ at the third axle (k-k'). If there are no other errors and $-M_1+M_2-M_3=0$, there are no relative errors between the truck (3) and the datum level.

(b) Behavior of the first distribution link ($24_1$)

It is assumed that the center of the axle (13) has moved as much as $M_1$ from b to b'. Then, the contact (a) of the connecting roller (29) (which is at a') moves over $\Delta_1$ to become stabilized. As the result, the point c' moves as much as $2M_1$ and the point c moves to a position where the angle c'-c-d is a right angle and c'-c=D. On the other hand, the point d is stationary and the arm length becomes $L+\Delta_2$. The system becomes stabilized with an error $\Delta_2$.

(c) Behavior of the third distribution link ($24_3$)

The third distribution link ($24_3$) also moves like the first distribution link ($24_1$). As the point k moves over $M_3$ to the point k', the point l moves as much as $\Delta_7$ and the point j' moves as much as $2M_3$. As the result, a right-angled triangle j'-j-h is formed.

(d) Behavior of the second distribution link ($24_2$)

The second distribution link ($24_2$) must move as much as $M_2$ from f to f' so that a balance is established. It is assumed that the movement from f to f' is vertical. A discrepancy $\Delta_4$ of R arises at g' where the line connecting e' and f' intersects the perpendicular line drawn from g. However, if $\Delta_3$ and $\Delta_5$ change within the range of $\pm\Delta$, f' moves from f horizontally as well as vertically and $\Delta_4$ becomes 0. Thus, the discrepancy disappears.

(e) Behavior of the entire truck (3)

As will be apparent from the above description, in accordance with the errors $M_1$, $M_2$, and $M_3$ of the rail (2), the arm length errors $\Delta_1$, $\Delta_2$, $\Delta_3$, $\Delta_4$, $\Delta_5$, $\Delta_6$, and $\Delta_7$ arise.

(f) Variation of load on the wheel (4)

As mentioned above, $\Delta_1$ to $\Delta_7$ are less than Δ and errors due to variation of load on the wheel (4) is very small as in the horizontal length errors. In the embodiment, the errors are ±3–5%, and the total errors including the horizontal length errors are ±10%. This can be regarded as complete load distribution in practical use.

(g) General demonstration

Even when the distribution link (24) is diplaced due to rolling resistance, balance is established as mentioned above, only with an increase of variation, so that the combined stress applied to the connecting rollers (29) at both ends of one distribution link (24) equals the wheel load (including rolling resistance) exerted between the wheel (4) and the rail (2). The above description for three-axle distribution link also applies to distribution links having more than three axles.

(h) Numerical demonstration

We will continue demonstration by substituting numerals for L and R in the above-mentioned embodiment. It is assumed that the truck (3) is 12,000 mm long and has ten axles and R=L=250 mm. It is further assumed that a cumulative error ±50 mm is tolerable at each wheel (4).

$\Delta_{max} = \pm 5.05$ mm

Variation of wheel load is ±2% at maximum.

Total variation is within ±6% even when the axle-to-axle pitch error is assumed to be ±10 mm.

These values demonstrate a very good uniformity in load distribution. In the conventional case where all the wheels are mounted directly on the truck, most wheels become idle and only a few wheels bear an excessive load when the wheels roll on an irregular rail.

The description on the embodiment shown in FIG. 12 covers case A in which the truck (3) and the rail (2) are straight and receive a downward load. The same description also applies to the following cases B to F.

Case B: The truck (3) and the rail (2) are circular, and there are three groups of wheels which are held between the end stoppers (32),(32). A downward load is received.

Case C: The arrangement in Case A is inverted so that an upward load is received.

Case D: The arrangement in Case B is inverted so that an upward load is received.

Case E: The arrangements in Case A and Case C are combined so that one group of wheels receives a downward load and another group of wheels receives an upward load.

Case F: The arrangements in Case B and Case D are combined so that one group of wheels receives a downward load and another group of wheels receives an upward load, as in a slewing bearing for a crane.

Figure 14:
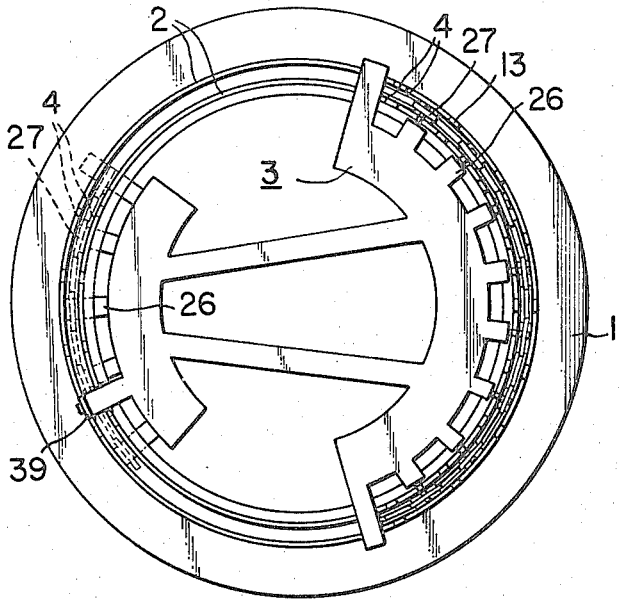
FIG. 14 is a plan view of a slewing crane based on the embodiment as shown in FIG. 12.
Figure 15:
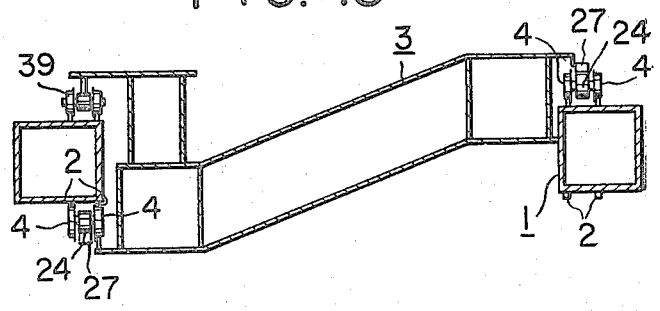
FIG. 15 is a sectional front view of the slewing crane as shown in FIG. 14.
Figure 16:
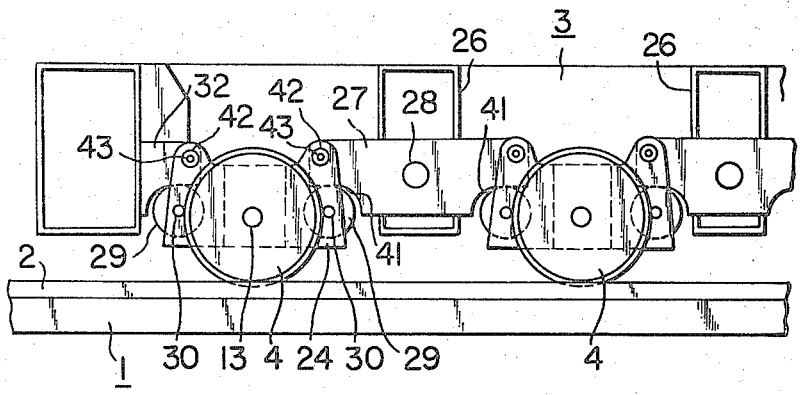
FIG. 16 is a front view of the load distribution links and wheels of the embodiment as shown in FIG. 14.

An embodiment corresponding to the above Case F is described referring to FIGS. 14 to 16.

The circular stationary base (1) is provided on its upper and lower surfaces with two each circular rails (2). Inside this stationary base (1) is installed the slewing frame (3) which functions as the above-mentioned truck. The embodiment shown in FIG. 14 corresponds to the above-mentioned Case F because the slewing frame (3) and rail (2) in the right half receive a downward load and those in the left half receive an upward load, the entire system receiving a moment of load. In FIGS. 14 to 16, the load distribution system is made up of the wheel (4), the distribution links (24) and (27), the connecting rollers (29), and the supporting plates (26).

In the arrangement as shown in FIG. 12, the connecting rollers (29) are employed and the wheels (4) are not connected with the slewing frame (3). In order to facilitate transportation, the wheels (4) may be connected to the slewing frame (3) by the pin (43) which is attached to the distribution link (27) and fitted loosely into the hole (42) made on the distribution link (24).

What is claimed is:

1. Means for distributing a load uniformly to wheels on a rail which comprises a truck, end stoppers a certain distance apart attached to the truck, one or more supporting plates attached to the truck at certain intervals between the end stoppers, at least one balancelike distribution link pivotally mounted on the supporting plate by a distribution pin, and a balancelike distribution link pivotally mounted on the axle of the wheel which rolls on the rail, said distribution link on the axle being movably connected at its both ends through a connecting body to said adjoining end stopper and distribution link on the truck, wherein the connecting body is a roller which is pivotally mounted on both ends of the distribution link on the axle, said roller being in contact with an arc-shaped surface, a said arc-shaped surface being made on the distribution link on the truck and on the end stopper.

2. Means for distributing a load uniformly to wheels as claimed in claim 1, wherein the truck is a slewing frame for a crane, the wheels are divided into three groups which are arranged at angular intervals of 120°, two groups of the wheels being installed on the upper side of the slewing frame so that the wheels support the hoisting load and dead load, the other group of the wheels being installed on the under side of the slewing frame so that the wheels receive a reaction force.

3. Means for distributing a load uniformly to wheels as claimed in claim 1, wherein all the wheels are installed on the under side of the truck so that a downward load is received.

4. Means for distributing a load uniformly to wheels as claimed in claim 1, wherein all the wheels are installed on the upper side of the truck so that an upward load is received.

5. Means for distributing a load uniformly to wheels as claimed in claim 2, wherein the wheels are divided into two groups, one group being installed upward on the slewing frame and the other group being installed downward on the slewing frame so that a moment of load is received.

6. Means for distributing a load uniformly to wheels on a rail which comprises a truck, end stoppers a certain distance apart attached to the truck, one or more supporting plates attached to the truck at certain intervals between the end stoppers, at least one balancelike distribution link pivotally mounted on the supporting plate by a distribution pin, and a balancelike distribution link pivotally mounted on the axle of the wheel which rolls on the rail, said distribution link on the axle being movably connected at its both ends through a connecting body to said adjoining end stopper and distribution link on the truck, wherein the connecting body is a roller which is pivotally mounted on both ends of the distribution link on the axle, said roller being in contact with an arc-shaped surface, a said arc-shaped surface being made on the distribution link on the truck and the end stopper, and wherein the distribution link on the axle is pivotally mounted directly on the axle.

7. Means for distributing a load uniformly to wheels as claimed in claim 6, wherein the truck is a slewing frame for a crane, the wheels are divided into three groups which are arranged at angular intervals of 120°, two groups of the wheels being installed on the upper side of the slewing frame so that the wheels support the hoisting load and dead load, the other group of the wheels being installed on the under side of the slewing frame so that the wheels receive a reaction force.

* * * * *